United States Patent [19]

Garrabrants

[11] 4,414,525

[45] Nov. 8, 1983

[54] SWITCH WITH REPLACEABLE FLASHER UNIT

[76] Inventor: Ralph S. Garrabrants, 3674 W. Dahlia, Phoenix, Ariz. 85027

[21] Appl. No.: 207,283

[22] Filed: Nov. 17, 1980

[51] Int. Cl.[3] ..... H01H 61/06

[52] U.S. Cl. ..... 337/92; 315/200 A

[58] Field of Search ..... 337/51, 92, 93, 94, 337/95, 96, 44, 138; 315/200 A

[56] References Cited

U.S. PATENT DOCUMENTS

| | | | |
|---|---|---|---|
| 3,681,730 | 8/1972 | Fortino | 337/92 |
| 3,953,817 | 4/1976 | Covert | 337/92 |
| 4,177,408 | 12/1979 | Mason | 315/200 A X |

*Primary Examiner*—George Harris

*Attorney, Agent, or Firm*—Don J. Flickinger

[57] ABSTRACT

A multi-throw switch cooperates with a bi-metallic, thermally actuated electrical contact for converting a continuously operating electrical circuit into one which operates intermittently. Method and apparatus are taught directed toward the use of commercially available, easily replaceable thermally actuated contact devices. In the embodiment disclosed, the familiar flasher unit originally designed to be incorporated in a lamp socket at the base of the light bulb is utilized as the readily available, easily replaceable thermally actuated, intermittent contact device. Method and means for retaining such a readily replaceable device and maintaining it in interconnection with a control switch and an associated electrical switch is disclosed.

6 Claims, 8 Drawing Figures

SWITCH WITH REPLACEABLE FLASHER UNIT

BACKGROUND

1. Field of the Invention

The invention relates to switching means for adapting a conventional continuously operating electric circuit to a circuit which functions intermittently. More particularly, the invention relates to switch means provided with a readily replaceable, commercially available flasher unit which may be incorporated into the electrical circuit by said switch means.

2. Prior Art

Thermally actuated bi-metallic switches are well known in the prior art. Such thermally actuated switches find use in thermostats, circuit breakers, and in thermally actuated delay switches. The use of thermally actuated bi-metallic switches is also well documented in the field in which their use provides for intermittent, flashing operation of a lamp circuit.

Typical of the teachings advocating the use of thermally actuated bi-metallic switches are those U.S. patents issued to Wortmann, No. 2,911,637; Canfield, No. 3,486,151; and to Dorsey, Sr. et al, No. 3,725,834. The schematic representation of the disclosure of these three patents is, for all practical purposes, patentably indistinguishable. It is, of course, apparent, upon review of these patents, that each is distinguishable from the others by the manner in which the electrical functioning of the invention is achieved.

Wortmann discloses a flashlight in which a specially fabricated, thermally actuated bi-metallic switch is incorporated at the base of the flashlight to provide intermittent, flashing operation of the lamp.

Canfield provides a specially fabricated switch assembly having as an integral part thereof a bi-metallic current conductor operative to produce interrupted current flow so as to provide intermittent operation of an associated electrical circuit.

Dorsey, Sr. et al provides a similar switch serving the same function as that of Canfield wherein the switch structure includes an integral bi-metallic, thermally actuated switch element.

As already noted, the three cited patents have generally indistinguishable schematic diagrams (Wortmann utilizes two switches, whereas Canfield and Dorsey, Sr. et al utilize a multiposition switch). They each contain one additional feature in common. Each of them uses a bi-metallic, thermally actuated switch which forms an integral part of the switching means utilized for adapting the associated electrical circuit for intermittent operation. As a result of the thermally actuated switch forming an integral part of the means utilized by them to achieve intermittent circuit operation, that means is not readily maintainable by one who is not a technician in the field, and maintenance will generally be by way of replacement of the entire switch assembly. Such replacement of the entire switch unit is an expensive expedient demanded by the use of integral bi-metallic, thermally actuated switch elements.

It is therefore an objective of the invention to provide means for adapting a continuously operating electrical circuit to one that functions intermittently.

It is a particular objective of the invention to provide means for adapting a conventional electrical circuit for intermittent operation which means are relatively inexpensive and simple to maintain.

It is a specific objective of the invention to provide switch means with an associated replaceable, commercially available flasher unit which may be incorporated into an existing electrical interconnection box for converting a conventional continuously operative electrical circuit to one in which the operator may choose to operate either continuously or intermittently.

It is a further objective of the invention to provide means for indicating the status of the invention when in use in adapting an electrical circuit to intermittent operation.

SUMMARY OF THE INVENTION

The invention provides means for adapting a conventional electric circuit so as to provide a choice of continuous or intermittent operation circuit. The invention is comprised of switch means for selecting at least one of continuous or intermittent operation of an associated electrical circuit. The switch means are adapted for mounting in a standard electrical interconnection box. A cartridge means is also provided for retaining a replaceable, commercially available flasher unit in electrical interconnection with the switch means and an associated electrical circuit. In a preferred embodiment of the invention disclosed herein, the cartridge means comprises a self-contained enclosure having means therein for making and retaining electrical connection between the replaceable flasher unit and the switch means and associated electrical circuit. The cartridge means provides ready access to the replaceable flasher unit such that an in-operative flasher unit may be simply removed and discarded and replaced with a new operative unit in a straightforward simple manner without the need for soldering or special purpose tools.

DETAILED DESCRIPTION OF THE INVENTION

Figure 1:
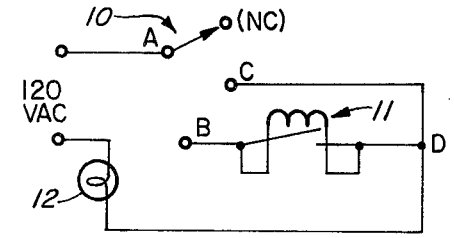
FIG. 1 (PRIOR ART)
FIG. 1 is a familiar schematic illustrating the function of the invention.

A schematic diagram of a circuit which may be adapted for continuous operation or for intermittent operation is illustrated in FIG. 1. Here, a multithrow switch 10 can select among a noncontacting position (NC), a continuous operating position (C), and an intermittent operating position (B). Intermittent operation is provided by the switch selection of bi-metallic thermally actuated switch element 11 which functions in a manner well known to those skilled in the art so as to cause intermittent current conduction through the circuit and its load, here illustrated for expository purposes as a lamp 12.

Figure 2:
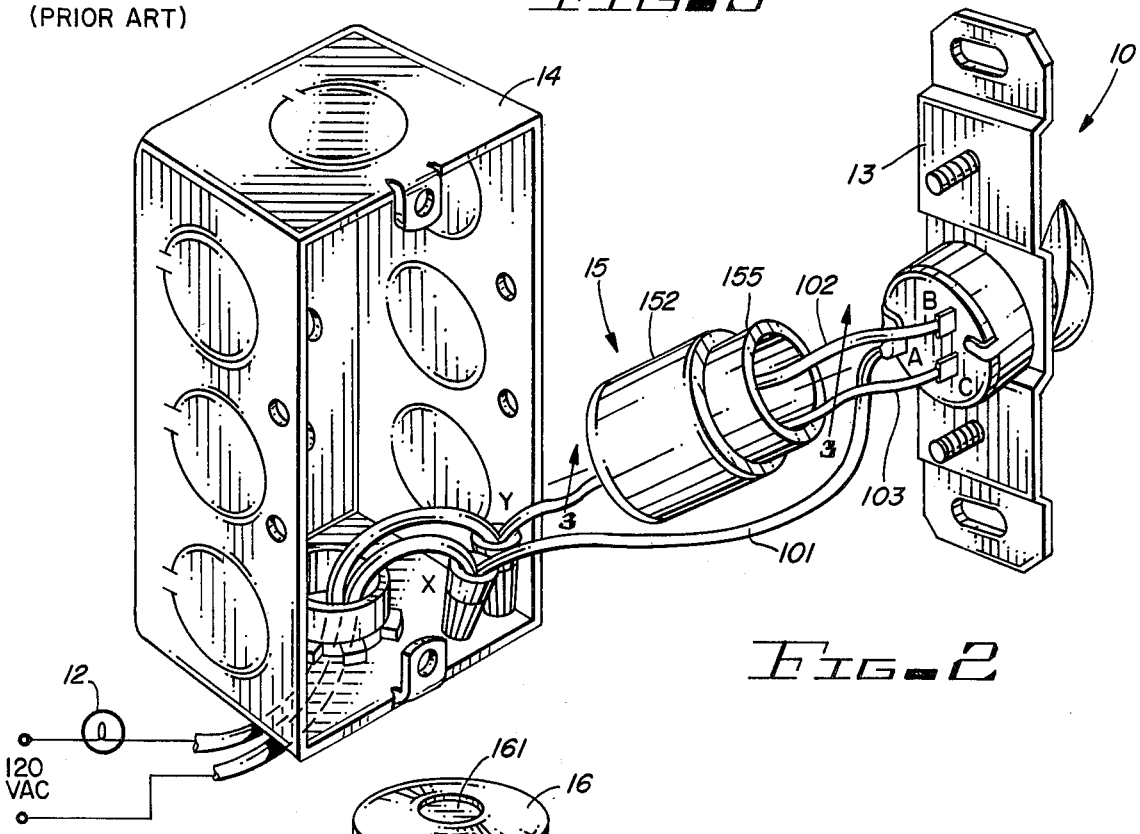
FIG. 2 is an expanded assembly drawing of a first embodiment of the invention.

In the drawing of FIG. 2, switch 10 is shown assembled to mounting plate 13 to permit its assembly with standard electrical interconnection box 14. Switch 10 is provided with electrical conductors 101, 102 and 103. Electrical conductor 101 is provided for connection of switch contact A to conductor X of the associated electrical circuit. Conductors 102 and 103 extend the switch 10 contacts B and C, respectively, to flasher unit cartridge 15. Electrical conductor 151 completes the circuit path from flasher unit cartridge 15 to conductor Y of the associated electrical circuit.

Figure 3:
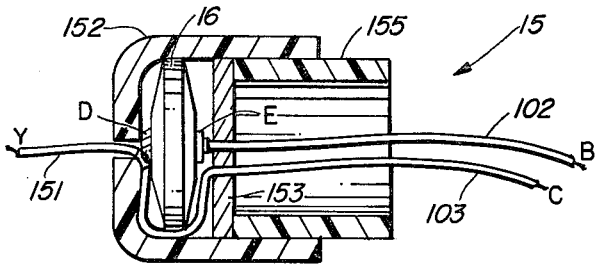
FIG. 3 is a cross-sectional view of the flasher retaining cartridge of the invention taken along line 3—3 of FIG. 2.
Figure 4:
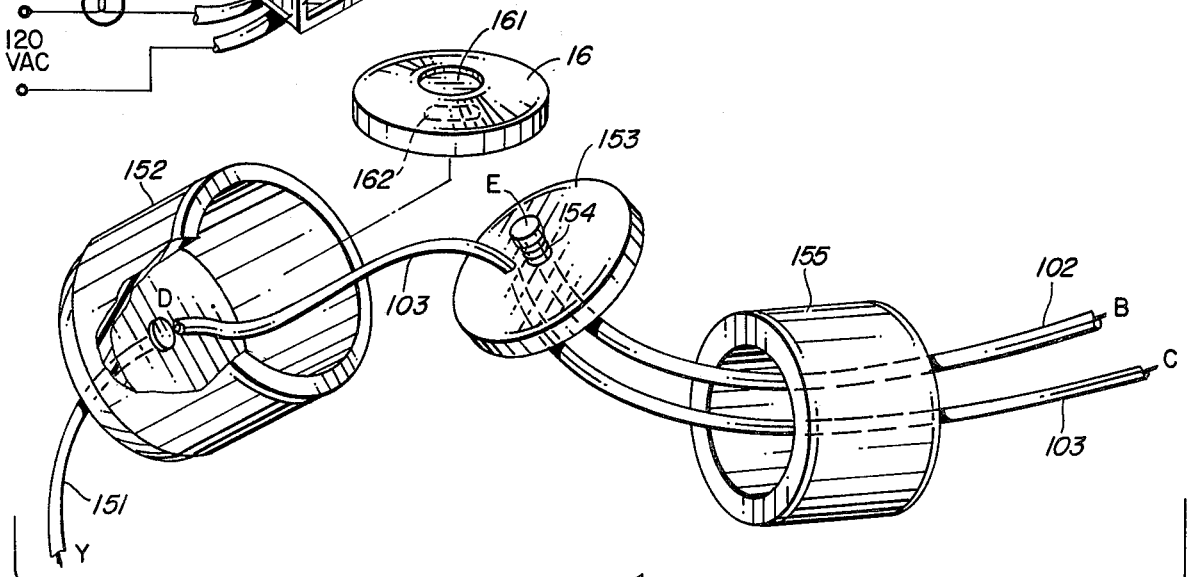
FIG. 4 is an expanded assembly drawing of the flasher retaining cartridge of FIGS. 2 and 3.
Figure 5:
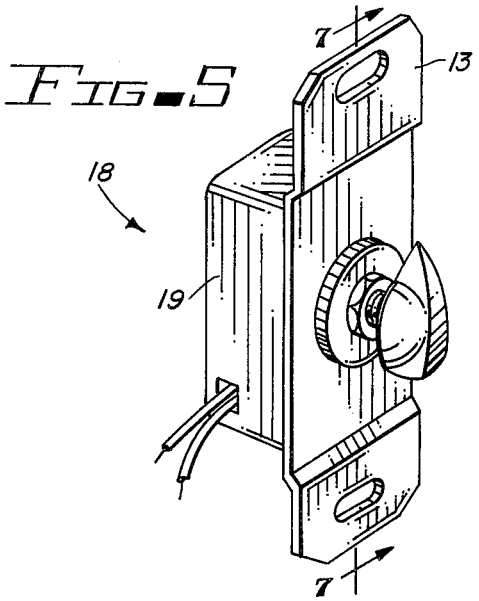
FIG. 5 is a perspective view of a second embodiment of the invention.

The details of flasher unit cartridge 15 are provided in FIGS. 3 and 4. Flasher retaining cartridge 15 is seen to comprise a cylinder 152, open at one end, adapted to accept a commercially available, replaceable flasher unit 16. Flasher unit 16 is provided with two conductive contacts 161 and 162. In the illustration of FIG. 4, only contact 161 is visible, conductive contact 162 being disposed on the face of flasher 16 opposite that illustrated. An electrical contact D is provided at the base of cylinder 152 so as to make intimate contact with conductive contact 162 of flasher 16 when flasher 16 is disposed within cylinder 152. Electrical conductor 103 mates contact C on switch 10 with contact D in cylinder 152. Conductor 151 provides the electrical interconnection between contact D and contact Y of the associated electrical circuit.

In order to make contact with the remaining electrically conductive contact 161 of flasher 16, an insertable disc is provided which bears spring-loaded contact E. Spring loading is provided by the action of spring 154. Electrical conductor 102 couples contact E to terminal B of switch 10.

With flasher unit 16 disposed within cylinder 152, disc 153 is inserted into cylinder 152 so as to contact flasher unit 16. Bezel ring 155 is then inserted into cylinder 152 and pressed downward so as to bring and maintain contact D in intimate contact with conductive contact 162 of flasher 16 and contact E in intimate contact with conductive contact 161 of flasher 16. Unlike conventional bezel rings, bezel ring 155 has an extended height so that it may be readily grasped by a simple tool, such as a pliers, and removed from cylinder 152 to permit the replacement of flasher unit 16. Bezel ring 155 is subject to relatively high frictional resistance when inserted or removed from cylinder 152. This frictional resistance maintains disc 153 in position above flasher unit 16 so that electrical contact to and from flasher unit 16 is maintained.

It is thus readily seen that with switch unit 10 and flasher retaining cartridge 15 installed within electrical interconnection box 14, switch 10 may be operated so as to cause lamp 12 to burn continuously or, by switching current through flasher unit 16, cause lamp 12 to operate intermittently. As is typical with flasher units, whether they be simple, easily replaceable units, the use of which is taught herein, or specially manufactured bi-metallic thermally actuated contacts such as espoused by the prior art, the making and breaking of the contact under load conditions sooner or later erodes the contact surfaces and the contacts, or the bi-metallic elements, must be replaced. Unlike the prior art which would have required replacement of the entire switch assembly with their specially fabricated, integral, bi-metallic, thermally actuated switch contacts, the present invention requires merely the simple replacement of flasher unit 16. Typical of the flasher units whose use is taught herein, are those manufactured by Eagle Electric Manufacturing Company, Inc. of Long Island City, New York.

Figure 7:
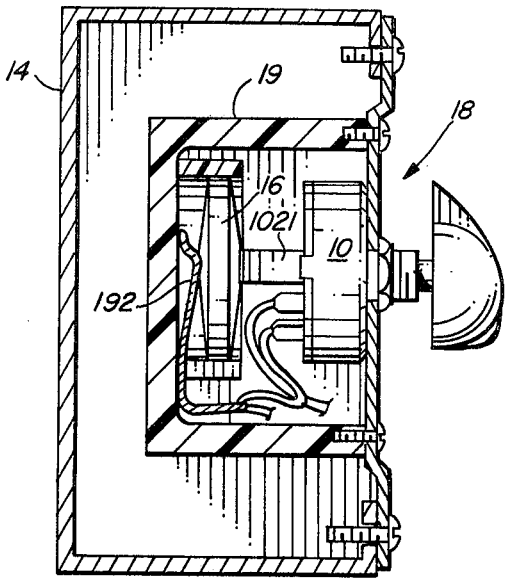
FIG. 7 is a cross-sectional view detailing the manner in which contact is made and maintained between flasher and switch units.
Figure 6:
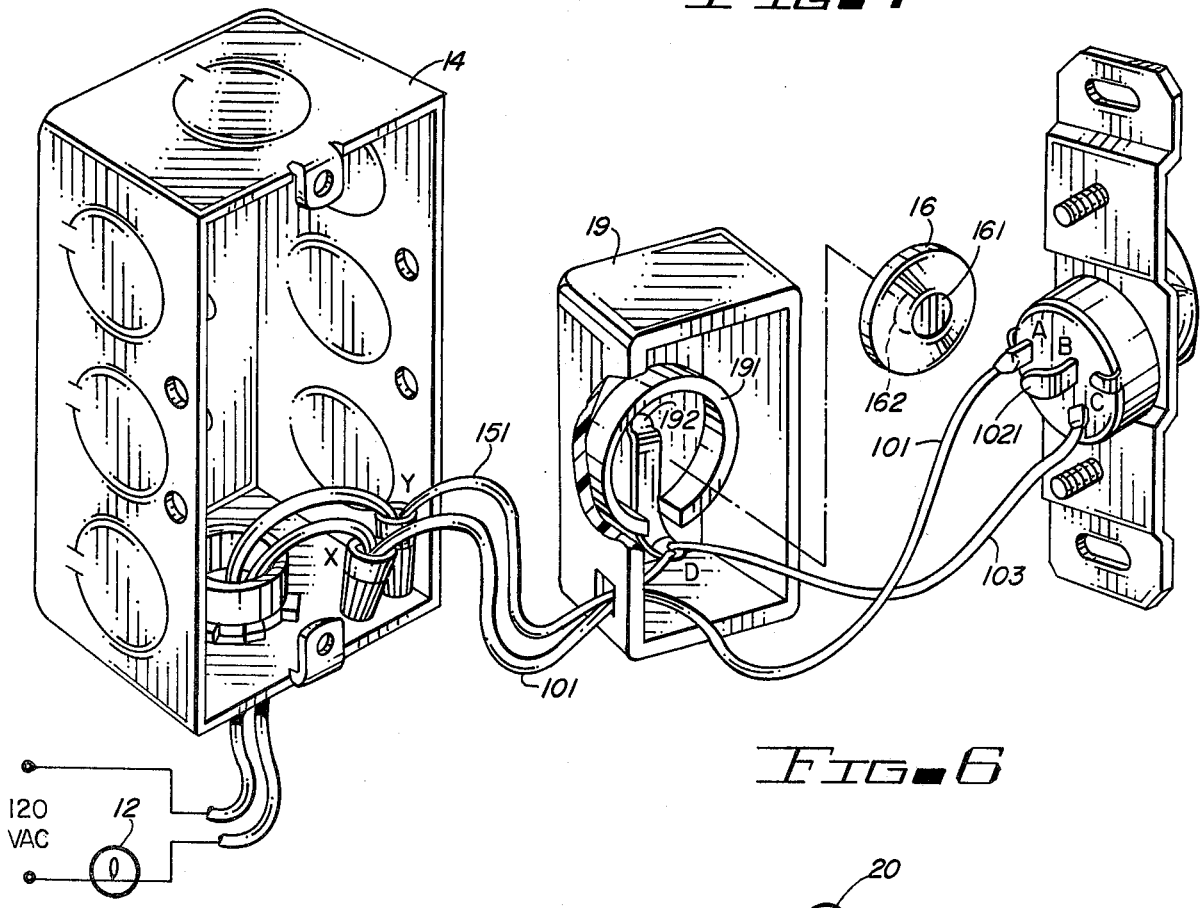
FIG. 6 is an expanded assembly drawing of the second embodiment of the invention.

In a second preferred embodiment of the invention, switch 10 and the flasher cartridge 15 are maintained as a single assembly rather than two separate units as indicated in FIG. 2. In assembly 18, box 19 fulfills the role of flasher retaining cartridge 15 of FIG. 2. Assembly 18 is detailed in the expanded assembly drawing of FIG. 6 and cross-sectional drawing of FIG. 7.

Box 19, serving as flasher unit cartridge, is provided with a raised cylindrical wall section 191 having an internal diameter which permits it to readily accept flasher unit 16. A spring contact 192 is deposed on the base of box 19 and positioned within raised wall section 191 so as to make intimate contact with the conductive contact 162 of flasher 16. The other end of spring contact 192 comprises terminal D which couples terminal C of switch 10, via conductor 103, to conductor 151 which makes contact with connector Y of the associated electrical circuit. As in the first embodiment of FIG. 2, contact A of switch 10 is connected via conductor 101 to contact X of the associated electrical circuit.

Unlike the first embodiment of the invention disclosed in FIGS. 2–4, the present embodiment places switch 10 in close proximity to flasher unit 16 disposed within cylindrical wall structure 191. To provide the intimate electrical contact between connector B of switch 10 and conductive contact 161 of flasher unit 16, a leaf spring extension is provided as conductor 1021 coupling contact B of switch 10 to conductive contact 161 of flasher 16. Spring contact 1021 serves an additional purpose to that of providing electrical conductive contact. The spring pressure exerted by contact 1021 on flasher unit 16 maintains flasher 16 within raised structure 19. Thus, electrical contact with the flasher is maintained while the flasher 16, itself, is physically retained in position within cylindrical structure 191.

When a flasher unit 16 requires replacement, assembly 18 may be readily removed from electrical interconnection box 14. Following this, mounting plate 16 is disconnected from box 19 and switch 10 is raised above box 19 thus making flasher unit 16 readily accessible for replacement. The reverse procedure completes the reassembly of the unit. Spring contact 1021 has been disclosed here as a leaf spring. This disclosure is made solely by way of exposition rather than of limitation and contact 1021 may assume any operable spring-loaded form, for example, a spiral spring.

Other embodiments of the invention utilizing commercially available, readily replaceable flasher units, or their equivalent, will be conceived by those skilled in the art. For purposes of exposition, the commercially available, readily replaceable bi-metallic, thermally actuated switch contact whose use is taught herein, has been referred to generically as a flasher unit. Use of this term is not to be considered limiting as to the style of thermally actuated unit employed in practicing the invention or as to the type of electrical loads made intimately operative thereby. The term "cartridge means" as used herein and in the appended claims is taken to define any means operable to retain a replaceable, readily available flasher unit in electrical interconnection with a switch and an associated electrical circuit.

Figure 8:
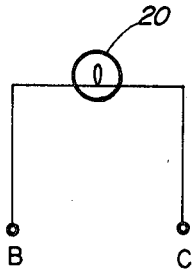
FIG. 8 illustrates an indicator lamp which may be coupled across the flasher unit to provide a visual status indication.

The invention may be readily employed by homeowners or building managers to cause a normally continuously energized exterior lamp to be energized intermittently as a form of an emergency signal. Thus, firemen, paramedics or other emergency workmen would be able to readily identify the premises in which an emergency condition existed. Because the load thrust into intermittent operation by practice of the invention, for example, an exterior lamp, will often be removed from visual observation of a person operating switch 10, an indicator lamp 20 (FIG. 8) may be coupled across switch contacts B and C (i.e., across flasher unit 16). This indicator lamp will provide a local status indication by flashing when switch 10 has been operative to insert flasher unit 16 into the conductive path of the associated circuit. Indicator lamp may be, for example, a neon lamp.

What has been disclosed is a multi-throw switch in cooperation with a bi-metallic, thermally actuated electrical contact for converting a continuously operating electrical circuit into one which operates intermittently. Method and apparatus are taught herein directed toward the use of commercially available, easily replaceable thermally actuated contact devices. In the embodiment disclosed, the familiar flasher unit originally designed to be incorporated in a lamp socket at the base of the light bulb has been utilized as the readily available, easily replaceable thermally actuated, intermittent contact device. Method and means for retaining such a readily replaceable device and maintaining it in interconnection with a control switch and an associated electrical circuit has been disclosed.

Those skilled in the art will conceive of other embodiments of the invention which may be drawn from the teachings herein. It is intended that all such embodiments so drawn shall fall within the ambit of protection provided by the claims appended hereto.

Having disclosed my invention in the foregoing specification and the accompanying drawings in such clear and concise manner that those skilled in the art will readily be able to understand and practice the invention, that which I claim is:

1. Means for adapting a conventional electrical circuit to provide a choice of continuous or intermittent operation comprising:

switch means adapted for mounting in a standard electrical interconnection box for selecting at least one of continuous and intermittent operation of an associated electrical circuit; and cartridge means for retaining a replaceable, commercially available flasher unit in electrical interconnection with said switch means and an associated electrical circuit, said cartridge means including:

a base;

first means affixed to said base for receiving said flasher unit;

spring contact means disposed on said base within said first means for contacting a conductive contact on said flasher unit; and a spring-loaded extension coupled directly to a contact on said switch means for contacting said flasher unit and for retaining said flasher unit within said first means.

2. The adapting means of claim 1 wherein said switch means comprises a part of said cartridge means enclosure.

3. The adapting means of claim 1 further comprising status indicating means coupled to a replaceable flasher unit retained by said cartridge means for indicating the operational status of said switch means.

4. The adapting means of claim 3 wherein said status indicating means is an indicator light which is intermittently energized when said conventional electrical circuit is adapted for intermittent operation.

5. The adapting means of claim 2 wherein said first means comprises a raised, substantially cylindrical wall having an internal diameter large enough to accept said flasher unit.

6. The adapting means of claim 5 wherein said spring loaded extension is a leaf spring.

* * * * *